US009756922B1

(12) United States Patent
Duthe et al.

(10) Patent No.: US 9,756,922 B1
(45) Date of Patent: Sep. 12, 2017

(54) CORDLESS ELECTRIC BLOW-DRYER SYSTEMS

(71) Applicants: Genevieve Duthe, Sainte-Marthe-sur-le-Lac (CA); Mathieu Giroux, Sainte-Marthe-sur-le-Lac (CA)

(72) Inventors: Genevieve Duthe, Sainte-Marthe-sur-le-Lac (CA); Mathieu Giroux, Sainte-Marthe-sur-le-Lac (CA)

( * ) Notice: Subject to any disclaimer, the term of this patent is extended or adjusted under 35 U.S.C. 154(b) by 18 days.

(21) Appl. No.: 13/890,935

(22) Filed: May 9, 2013

Related U.S. Application Data

(60) Provisional application No. 61/644,897, filed on May 9, 2012.

(51) Int. Cl.
*A45D 20/12* (2006.01)

(52) U.S. Cl.
CPC ..... *A45D 20/12* (2013.01)

(58) Field of Classification Search
CPC ..... A45D 20/00; A45D 20/12; D06C 5/00; F26B 21/00; F26B 25/00; F26B 3/00; F26B 9/00; D06F 58/00; D06F 58/02; D06F 58/20
USPC ..... 34/97, 104, 105, 381; 68/19, 20, 213; 15/303; 223/51
See application file for complete search history.

(56) References Cited

U.S. PATENT DOCUMENTS

| | | | | |
|---|---|---|---|---|
| 3,513,564 | A * | 5/1970 | Gramprie | 34/104 |
| 5,155,925 | A * | 10/1992 | Choi | 34/97 |
| 5,873,178 | A * | 2/1999 | Johnson | 34/90 |
| 6,889,448 | B1 * | 5/2005 | Frew | 34/417 |
| 7,043,854 | B2 * | 5/2006 | Peet et al. | 34/381 |
| 2004/0106080 | A1 * | 6/2004 | Vandrak et al. | 432/222 |
| 2008/0189991 | A1 * | 8/2008 | Cavada | 38/75 |
| 2011/0067422 | A1 * | 3/2011 | Ichishi et al. | 62/176.1 |
| 2011/0099831 | A1 * | 5/2011 | Parisi et al. | 34/92 |

FOREIGN PATENT DOCUMENTS

JP 3-244998 * 10/1991

* cited by examiner

*Primary Examiner* — Stephen M Gravini
(74) *Attorney, Agent, or Firm* — RG Patent Consulting, LLC; Rachel Gilboy

(57) ABSTRACT

A cordless electric blow-dryer system is a highly efficiency blow-dryer system that incorporates a steam generator, a heat exchanger, and a high efficiency battery into a cordless housing to eliminate draped and tangled power cords in professional hair styling stations and homes for safe, convenient use. The cordless electric blow-dryer system may also be used in locations where power outlets are unavailable. The handle may have a grip with resiliently deformable material, a power slide switch, a temperature limit setting, and a cool down button. The battery(s) slide into the bottom of the handle to power the device.

19 Claims, 7 Drawing Sheets

CORDLESS ELECTRIC BLOW-DRYER SYSTEMS

CROSS-REFERENCE TO RELATED APPLICATION

The present application is related to and claims priority from prior provisional application Ser. No. 61/644,897, filed May 9, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of hair blow dryers and more specifically relates to a cordless electric blow-dryer system.

DESCRIPTION OF THE RELATED ART

A blow-dryer or hair dryer is an electromechanical device designed to blow cool or hot air over wet or damp hair, in order to accelerate the evaporation of water particles and dry the hair. Blow-dryers allow to better control the shape and style of hair, by accelerating and controlling the formation of temporary hydrogen bonds inside each strand. These hydrogen bonds are very powerful (allowing for stronger hair shaping than even the sulfur bonds formed by permanent waving products), but are temporary and extremely vulnerable to humidity. They disappear with a single washing of the hair. Hairstyles using blow-dryers usually have volume and discipline, which can be further improved by the use of styling products and hairbrushes during drying to add tension, hold and lift. Blow-dryers have virtually become a household item in every industrialized nation in the world. Entire industries depend on the styling speed and fashionable hairstyles afforded by the advent of the blow-dryer.

Individuals often find hairstyles that compliment their appearance that can only be created using a blow-dryer and it becomes a permanent part of their daily regimen. It can be perceived as quite an inconvenience when traveling and power outlets or a blow-dryer is unavailable. Individuals normally desire to look their best to friends and acquaintances. Additionally, most blow-dryer created hairstyles require a location that has a power outlet and a mirror. While a mirror is portable, a power outlet is not.

A second problem exists for professional hair stylists that work in hair styling stations. Nearly all of the powered tools used by stylists and haircutters have power cords that tend to become twisted and tangled after a few cuts becoming potential trip hazards. In addition, the common over-use of a single power outlet with multiple powered tools plugged into power strips is nearly always an OSHA workplace code violation. A solution that will effectively eliminate the inconvenience and cord hazards is needed; yet does not violate the appropriate electrical codes.

Various attempts have been made to solve the above-mentioned problems such as those found in U.S. Pat. And Pub. Nos. 2008/0216339; U.S. Pat. Nos. 4,555,232; 7,926,198; 7,380,347; 5,857,262; and 4,635,382. This art is representative of blow dryers. None of the above inventions and patents, taken either singly or in combination, is seen to describe the invention as claimed.

Ideally, a cordless blow-dryer should require low power consumption and provide convenience, and yet would operate reliably and be manufactured at a modest expense. Thus, a need exists for a reliable cordless electric blow-dryer system to dry and style hair without the inconvenience of tangled cords, inconvenient power outlet locations and to avoid the above-mentioned problems.

BRIEF SUMMARY OF THE INVENTION

In view of the foregoing disadvantages inherent in the known blow-dryer art, the present invention provides a novel cordless electric blow-dryer system. The general purpose of the present invention, which will be described subsequently in greater detail, is to provide freedom from tangled cords and inconvenient power outlet locations while having extended battery use times.

The cordless electric blow-dryer system as disclosed herein, in a preferred embodiment, may comprise a blow-dryer assembly having a dryer housing with at least two housing portions, at least one air intake port and a nozzle, a motor, a blower, a steam generator, a heat exchanger, a handle (having a bottom end and a top end), a power switch, a heat disconnect switch, a temperature control, and at least one rechargeable battery.

The housing portions of the dryer housing abut to each other such that the housing portions are able to be removably fastened together to form a hollow containment means thereby shrouding the device. The hollow containment may have at least one air intake port formed integrally with the dryer housing and a nozzle. The nozzle may further comprise a circular safety grill concentrically and perpendicularly attached to the discharge end of the nozzle. The nozzle of the blow-dryer assembly may also comprise high temperature insulation attached about the inner periphery of the nozzle of the blow-dryer assembly to provide efficiency and safety in operation.

The power switch is able to complete an electrically conductive circuit between the rechargeable battery or batteries, and the steam generator. The power switch is also able to complete an electrically conductive circuit between the rechargeable battery(s) and the motor. The motor is located within the dryer housing and is in communication with the power switch such that slideably activating the power switch causes the motor to be activated. The blower is coupled to the motor within the dryer housing such that when the motor is rotateably operated, the blower is able to pull ambient air through the intake port and discharge the ambient air through the nozzle.

The steam generator is mounted within the dryer housing and is in communication with the power switch such that slide-activating the power switch powers the steam generator. The steam generator is a sealed tube having a measured volume of H2O interiorly contained and may comprise a fill-valve. An alternate embodiment may comprise a hydrosonic pump having a water reservoir. The heat exchanger is mounted within the dryer housing and is in communication with the power switch such that the ambient air discharged through the nozzle is heated via the heat exchanger. The heat exchanger is a sealed tube having a measured volume of H2O interiorly contained which may be located within the nozzle or may be located within the handle for an ergonomically improved balance.

The top end of the handle is non-removably attached to the dryer housing at about a 90 degree angle to a longitudinal centerline of the dryer housing. The handle may further have a grip that substantially covers the handle and be constructed of a resiliently deformable material. The power switch is mounted within the handle such that the power switch is operable by a user exteriorly of the handle and is in communication with the rechargeable battery(s).

The heat disconnect switch is mounted within the handle such that it is operable by the user exteriorly of the handle. The heat disconnect switch acts as a cool-down switch to reduce output air temperature or cool the interior of the blow-dryer assembly. The heat disconnect switch preferably operates by interrupting an electrically conductive circuit between the rechargeable battery and the heat exchanger to reduce the output air to ambient temperature. The temperature control is mounted within the handle and is adjustable by the user exteriorly of the handle to maintain a user preferred internal temperature of between 250 degrees Fahrenheit and 500 degrees Fahrenheit.

The blow-dryer assembly may further comprise a thermal fuse for preventing the air discharge temperature of the nozzle from exceeding 140 degrees Fahrenheit to increase a safety factor. The thermal fuse may comprise an automatic reset that re-connects when the temperature drops to a pre-determined temperature. The rechargeable battery(s) is slideably insertable into the bottom end of the handle where it contacts conductive points to the power switch, the temperature control, and the heat disconnect switch.

The rechargeable battery(s) may comprise a lithium ion iron phosphate battery in preferred embodiments which may be able to power the blow-dryer assembly for 1 hour at full power. The blow-dryer assembly further comprises a battery recharging cradle having a power cord for connection to 120 volts or 220 volts alternating current. The cordless electric blow-dryer system is useful for convenient cordless styling of a user's hair or of the client's hair of a styling specialist using new compact technology.

The cordless electric blow-dryer system may comprise a kit having at least one fully assembled blow-dryer assembly, at least one rechargeable battery, at least one battery recharging cradle, and at least one set of user instructions. A method of using the cordless electric blow-dryer system may comprise the steps of inserting at least one rechargeable battery, setting a temperature control, sliding the power switch to an on position, using the blow-dryer assembly, press-holding the heat disconnect switch to blow ambient temperature air, and placing the blow-dryer assembly on the battery recharging cradle for recharging between uses.

The present invention holds significant improvements and serves as a cordless electric blow-dryer system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, cordless electric blowdryer system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a cordless blow-dryer device and more particularly to a cordless electric blow-dryer system as used to improve the safety, portability, and convenience of styling hair.

Generally speaking, a cordless electric blow-dryer system is a high efficiency blow-dryer system that incorporates a steam generator, a heat exchanger, and a high efficiency battery into a cordless housing to eliminate draped and tangled power cords in professional hair styling stations and homes for safe, convenient use. The cordless electric blow-dryer system may also be used in locations where power outlets are unavailable. The handle may have a grip with resiliently deformable material, a power slide switch, a temperature limit setting, and a cool down button. The battery(s) slide into the bottom of the handle to power the device for use.

Figure 1:
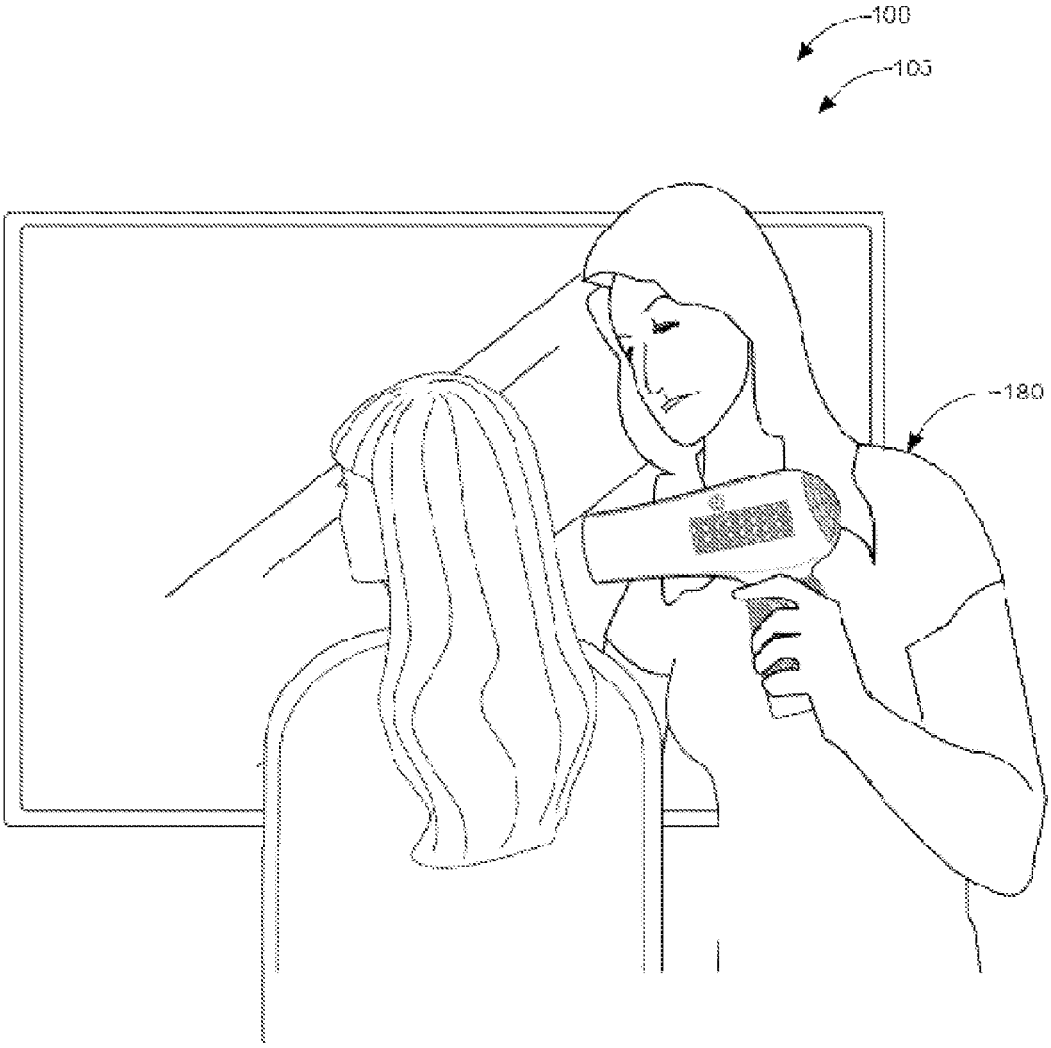
FIG. 1 shows a perspective view illustrating an in-use condition of a cordless electric blow-dryer system according to an embodiment of the present invention.

Referring to the drawings by numerals of reference there is shown in FIG. 1, a perspective view illustrating an in-use condition of cordless electric blow-dryer system 100 according to an embodiment of the present invention.

Figure 2A:
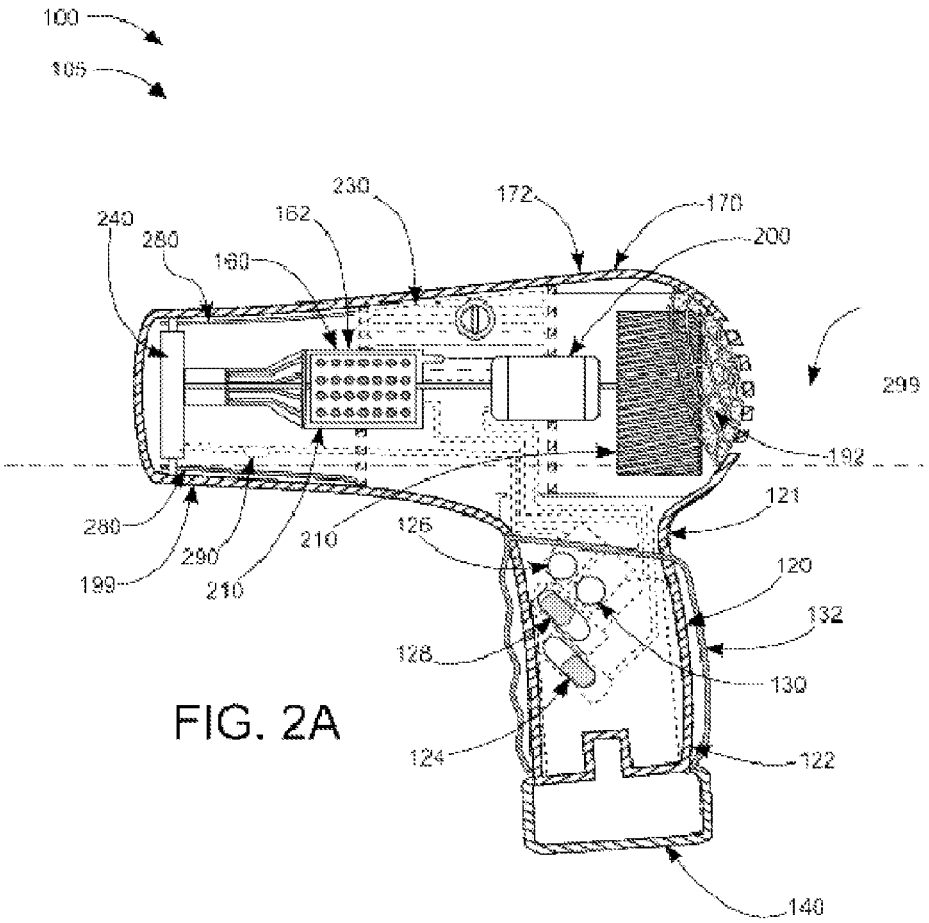
FIG. 2A shows a cutaway view of a preferred embodiment.

Cordless electric blow-dryer system 100 is a hair styling system designed for portability, convenience, safety, and for the professional hair dresser. Cordless electric blowdryer system 100 eliminates the necessity of having a cord attached to handle 120 of blowdryer assembly 105 by utilizing a high efficiency rechargeable battery 140 system while maximizing efficiency through the use of highly efficient internal components. Rechargeable battery(s) 140 may comprise a lithium ion iron phosphate battery which may be able to power blow-dryer assembly 105 for 1 hour at full power. Other forms of batteries may be used in alternate embodiments. Blow-dryer assembly 105 further comprises battery recharging cradle 150 having a power cord for connection to 120 volts or 220 volts alternating current (or other). A preferred recharging device, as shown in FIG. 3B, will comprise recharge holster 152 which is a circular ring having a positive and a negative charging contact on the inner periphery of recharge holster 152. Recharge holster 152 preferably has table clamp 154 for attachment to the edge of a table, but may have a flange for permanent mounting. Cordless electric blow-dryer system 100 is useful for convenient cordless styling of hair and excellent for use by commercial styling specialists using new compact technology. In a third embodiment as shown in FIGS. 2A, 4A, and 4B an efficient hydrosonic steam generator 160 may be incorporated into blow-dryer housing 170 to aid user 180 in style-setting hair. In the embodiment having hydrosonic steam generator 160, blow-dryer assembly 105 may also comprise liquid reservoir 230 as a source for steam.

Alternate embodiments may also have a car charger kit, a heap filter, a temperature charger, a travel kit having one rechargeable battery 140 and a recharger for use with a vehicle's power outlet or cigarette lighter, and a movement watch, or any combination of the above components.

Figure 2B:
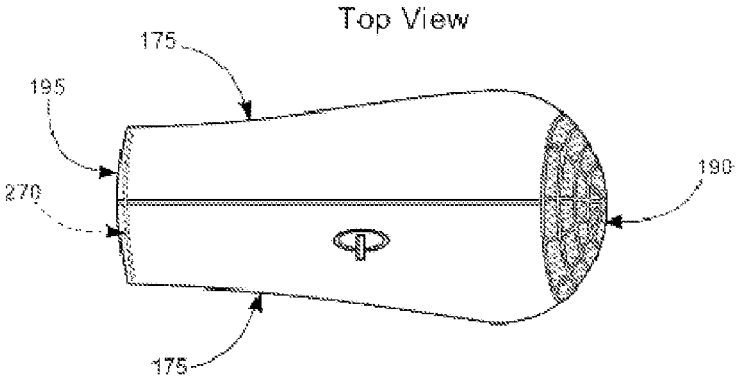
FIG. 2B, shows an overhead view.
Figure 2C:
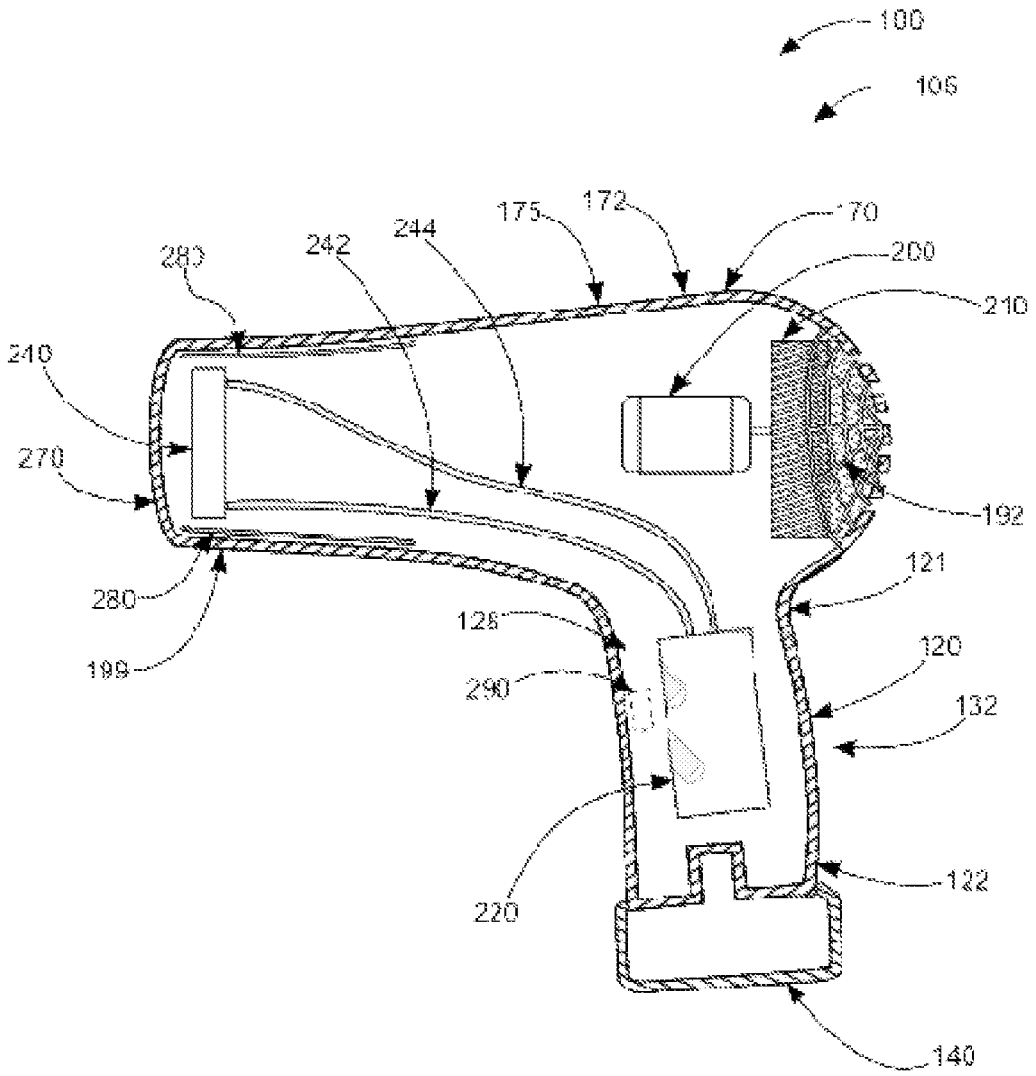
FIG. 2C shows an embodiment having a steam generator, all of the cordless electric blow-dryer system according to embodiments of the present invention of FIG. 1.

Referring now to FIG. 2A showing a preferred embodiment, and FIG. 2B, showing an overhead view, and FIG. 2C showing an embodiment having a steam generator all of cordless electric blow-dryer system 100 according to embodiments of the present invention of FIG. 1.

Referring to FIG. 2B, an embodiment of Cordless electric blow-dryer systems 100 is a hair dryer operated by battery power. This product can comprise hollow containment 172, at least one rechargeable battery(s) 140, at least one steam generator 220, at least one blower 210, at least one motor 200, at least one air intake screen 192, at least one heat exchanger 240, supply pipe 242, return pipe 244, at least one high temperature insulation 280, at least one thermal fuse 290, and at least one circular safety grill 270. The blower 210 is operatively connected to motor 200. Steam generator 220 and motor 200, which are contained within housing portion(s) 175, are operatively connected to and are powered entirely by rechargeable battery(s) 140. Heat exchanger 240 is a sealed tube having a measured volume of H2O interiorly contained which may be located within nozzle 199 or may be located within handle 120 for an ergonomically improved balance. Cordless electric blow-dryer system 100 may comprise at least one control switch which is power switch 124 and a speed control switch. Rechargeable battery(s) 140 is either replaceable or rechargeable and contained within handle 120 of the unit. Rechargeable battery(s) 140 may be a lithium ion iron phosphate (LiFePO4) battery. Cordless electric blow-dryer systems further may comprise handle 120 and housing portion(s) 175, handle 120 and housing portion(s) 175 being substantially perpendicular to each other, and grip 132 made of a resiliently deformable material that substantially covers handle 120.

Cordless electric blow-dryer systems may have temperature control 128 to control the air output between approximately 250 degrees Fahrenheit and approximately 500 degrees Fahrenheit. This unit may also feature heat disconnect switch 130 which is a cool-down button option. Rechargeable battery(s) 140 may be a lithium ion iron phosphate (LiFePO4) battery. The product may come with two of these rechargeable battery(s) 140. This rechargeable battery(s) 140 may last approximately an hour at maximum power before requiring a recharge. Handle 120, in this embodiment, is connected to housing portion(s) 175 at approximately a 90° angle, although it is to be understood that the angle of the connection is not critical to the invention. Heat disconnect switch 130, or the cool down button, operates by shutting off steam generator 220 so that blow-dryer assembly 105 only blows room temperature air. Power switch 124, in this embodiment, is the on/off button, along with the speed control, although it is to be understood that power switch 124 could take any form related to control functions, as long as chosen using sound engineering judgment. Power switch 124 allows the user to vary the temperature of blow-dryer assembly 105 as desired. Motor 200 is operatively connected to blower 210, and motor 200 is in operation, blower 210 blows air forward through hollow containment 172 and out nozzle 199. Steam generator 220 and motor 200 are operatively connected to rechargeable battery(s) 140.

Temperature control 128 which ranges in temperature from 250 degrees F. to 500 degrees F., can be designed to vary between any temperature ranges chosen using sound engineering judgment, making it easy to determine the appropriate heat for the hair. In one embodiment of the invention, temperature control 128 is variably adjustable. Thermal fuse 290 will shut down steam generator 220 if the temperature of the air goes higher than 140 degrees F. at nozzle 199 discharge. Blow-dryer assembly 105, in an alternate embodiment, can be powered by two rechargeable battery(s) 140, each lasting about 1 hour at maximum power, which are made of lithium ion iron phosphate (LiFePO4), although it is to be understood that any type of power source could be used to provide power, provided chosen using sound engineering judgment. Battery recharging cradle 150 has positive node 142 and negative node 144 which is located within the recess on the table top charger, and on the inner periphery of the ring of recharge holster 152. The operation of rechargeable battery(s) 140, heat exchanger 240, motor 200, and blower 210 are all well known in the art, and will not be further described herein. It is also to be understood that any number of batteries can be used, as long as chosen using sound engineering judgment. Blow-dryer assembly 105 comes with two rechargeable battery(s) 140 each with a charge span of 1 hour. There is a stand/battery charger/that charges rechargeable battery(s) 140. Battery recharging cradle 150 has a cradle for rechargeable battery(s) 140, and the battery recharging cradle 150 has power cord 156. In this embodiment, the blow-dryer assembly 105 also has the ability to blow cool air.

Cordless electric blow-dryer system 100 may comprise blow-dryer assembly 105 having blow-dryer housing 170 with at least two housing portion(s) 175, at least one air intake port 190 and nozzle 199, motor 200, blower 210, steam generator 220, heat exchanger 240, handle 120 having bottom end 122 and top end 121, power switch 124, heat disconnect switch 130, temperature control 128, and at least one rechargeable battery(s) 140.

Housing portion(s) 175 of blow-dryer housing 170 abut to each other such that housing portion(s) 175 are able to be removably fastened together to form hollow containment 172. Hollow containment 172 (volume formed) may have at least one air intake port 190 formed integrally with blow-dryer housing 170 and nozzle 199. Nozzle 199 may further comprise circular safety grill 270 concentrically and perpendicularly attached to discharge end 195 of nozzle 199. Nozzle 199 of blow-dryer assembly 105 may also comprise high temperature insulation 280 attached about inner periphery of nozzle 199 of blow-dryer assembly 105. Heat exchanger 240 is a sealed tube having a measured volume of H2O interiorly contained and may be located within the nozzle or may be located within the handle for an ergonomically improved balance.

Blow-dryer assembly 105 may further comprise thermal fuse 290 for preventing air discharge temperature of nozzle 199 from exceeding 140 degrees Fahrenheit. Thermal fuse 290 may comprise an automatic reset that re-connects when the temperature drops to pre-determined temperature. Rechargeable battery(s) 140 is slideably-insertable into bottom end 122 of handle 120 where it contacts conductive points to power switch 124, temperature control 128, and heat disconnect switch 130.

Figure 3A:
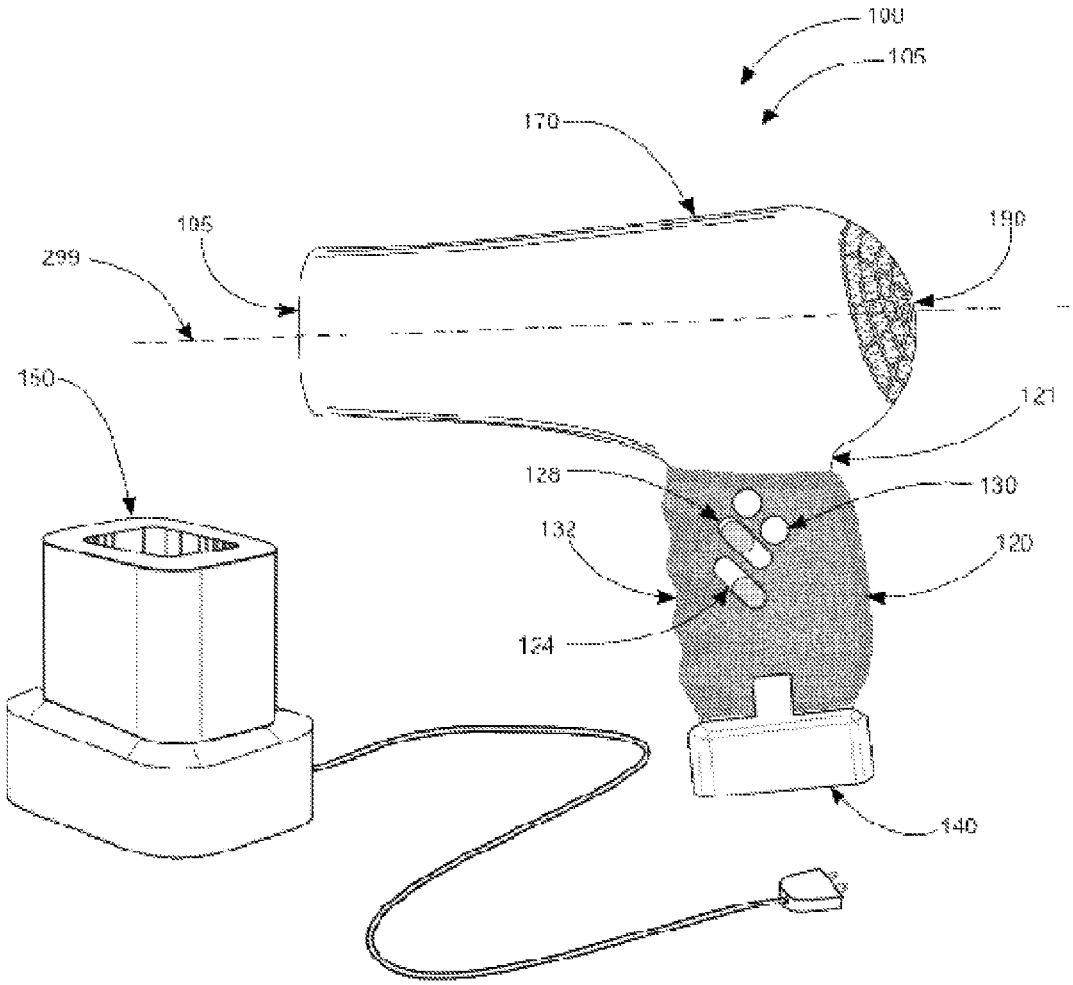
FIGS. 3A and 3B are perspective views illustrating the exterior of cordless electric blow-dryer system with a battery recharging cradle and a recharge holster respectively according to an embodiment of the present invention of FIG. 1.
Figure 3B:
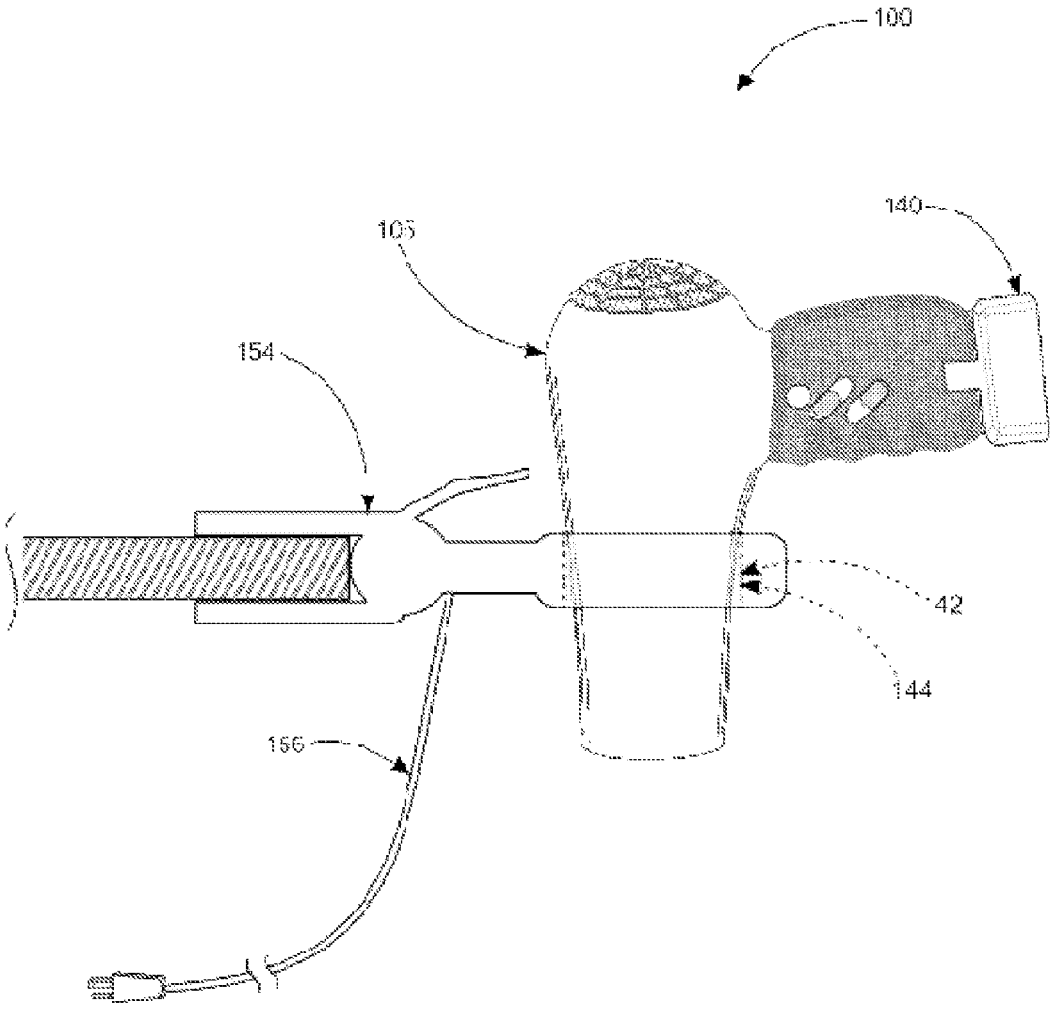
Figure 4A:
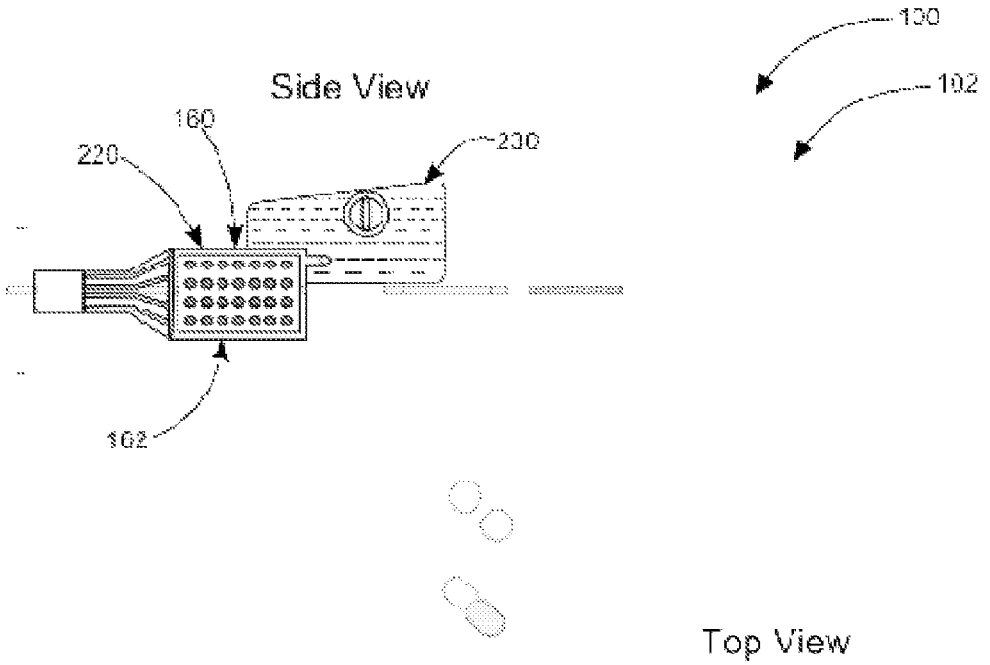
FIGS. 4A and 4B are perspective views illustrating a steam generator of the cordless electric blow-dryer system according to an embodiment of the present invention of FIG. 1.
Figure 4B:
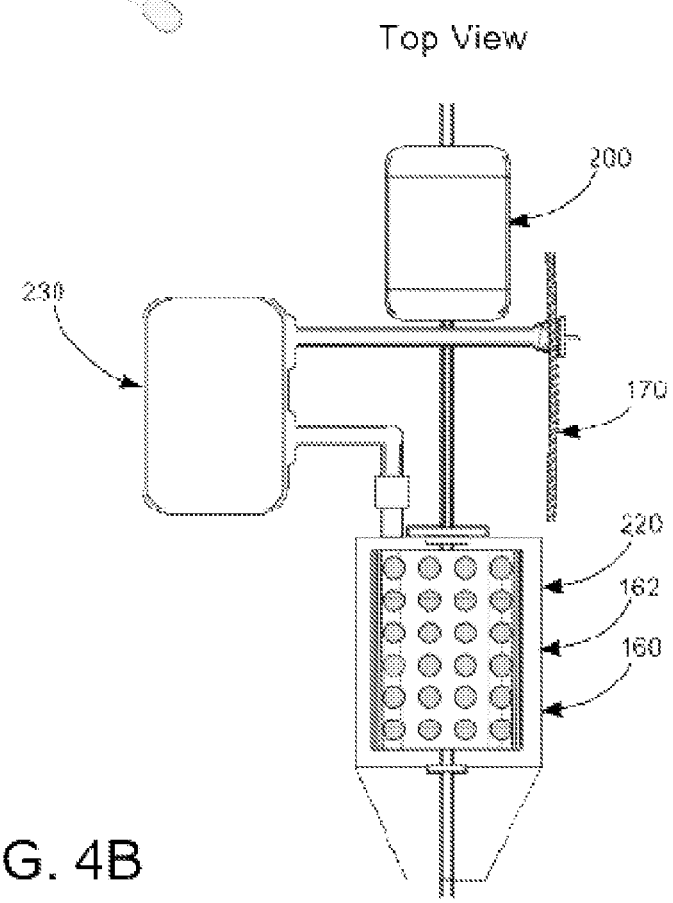

Referring now to FIGS. 3A and 3B are perspective views illustrating the exterior of cordless electric blow-dryer system 100 with battery recharging cradle 150 and recharge holster 152 respectively according to an embodiment of the present invention of FIG. 1.

Top end 121 of handle 120 is non-removably attached to blow-dryer housing 170 at about a 90 degree angle to longitudinal centerline 299 of blow-dryer housing 170. Handle 120 may further have grip 132 that substantially covers handle 120 and be constructed of a resiliently deformable material. Power switch 124 is mounted within handle 120 such that power switch 124 is operable by user 180 exteriorly of handle 120 and is in communication with rechargeable battery(s) 140. Heat disconnect switch 130 is mounted within handle 120 such that it is operable by user 180 exteriorly of handle 120. Heat disconnect switch 130 acts as a cool-down switch to reduce output air temperature or cool the interior of blow-dryer assembly 105. Heat disconnect switch 130 operates by interrupting an electrically conductive circuit between rechargeable battery(s) 140 and heat exchanger 240 to reduce output air to ambient temperature. Temperature control 128 is mounted within handle 120 and is adjustable by user 180 exteriorly of handle 120 to maintain user 180 preferred internal temperature of between 250 degrees Fahrenheit and 500 degrees Fahrenheit. Some embodiments may have a solar panel integrated into blow-dryer housing 170 for charging rechargeable battery(s) 140 when utility power is not available.

Referring now to FIGS. 4A and 4B, perspective views illustrating an alternate embodiment having hydrosonic pump 160 of the cordless electric blow-dryer system 100 according to an embodiment of the present invention of FIG. 1.

In an alternate embodiment, hydrosonic steam generator 160 is mounted within blow-dryer housing 170. Heat exchanger 240 is mounted within blow-dryer housing 170 and is in communication with power switch 124 such that ambient air discharged through nozzle 199 is heated via heat exchanger 240.

Power switch 124 is able to complete an electrically conductive circuit between rechargeable battery(s) 140 and motor 200. Motor 200 is located within blow-dryer housing 170 and is in communication with power switch 124 such that slideably activating power switch 124 causes motor 200 to be activated. Blower 210 is coupled to motor 200 within blow-dryer housing 170 such that when motor 200 is rotateably operated, blower 210 is able to pull ambient air through air intake port 190 and discharge ambient air through nozzle 199.

Cordless electric blow-dryer system 100 may be sold as kit 450 comprising the following parts: at least one at least one fully assembled blow-dryer assembly 105; at least one rechargeable battery(s) 140; and at least one set of user instructions. Cordless electric blow-dryer system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different powering combinations, parts may be sold separately, etc., may be sufficient.

Figure 5:
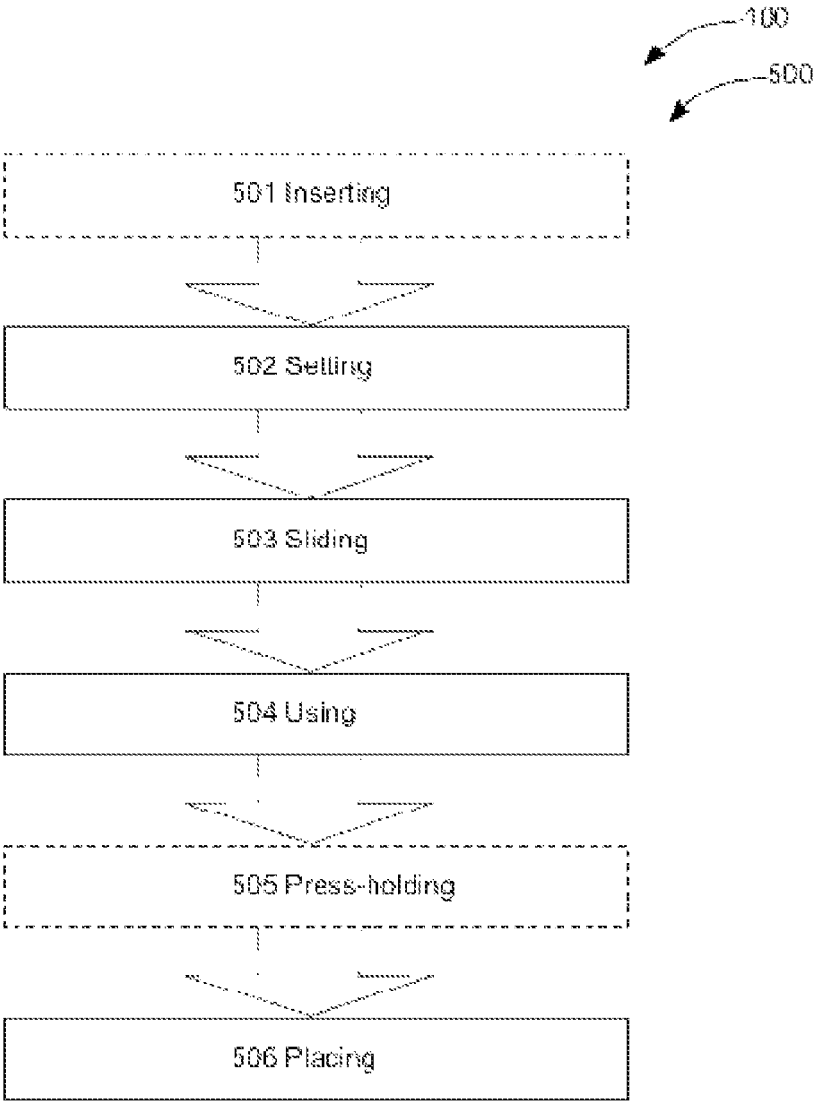
FIG. 5 is a flowchart illustrating a method of use for the cordless electric blow-dryer system according to an embodiment of the present invention of FIGS. 1-4B.

Referring now to FIG. 5, a flow chart illustrating method of use 500 for cordless electric blow-dryer system 100.

A method of use 500 for cordless electric blow-dryer system 100 may comprise the steps of: step one 501 inserting at least one rechargeable battery(s) 140; step two 502 setting temperature control 128; step three 503 sliding power switch 124 to an on position; step four 504 using blow-dryer assembly 105; step five 505 press-holding heat disconnect switch 130 to blow ambient temperature air; and step six 506 placing blow-dryer assembly 105 on battery recharging cradle 150 for recharging between uses.

It should be noted that steps 501 and 505, are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A cordless electric blow-dryer system comprising:

a blow-dryer assembly having;

a dryer housing having;

at least two housing portions;

at least one air intake port; and a nozzle;

a motor;

a blower;

a steam generator;

a heat exchanger;
a handle having a bottom end and a top end;
a power switch;
a heat disconnect switch;
a temperature control; and
at least one rechargeable battery;

wherein said at least two housing portions of said dryer housing abut to each other such that said housing portions are able to be removably fastened together to form a hollow containment, said hollow containment having at least one air intake port and said nozzle formed integrally with said dryer housing;

wherein said motor is located within said dryer housing and is in communication with said power switch such that slideably activating said power switch causes said motor to be activated;

wherein said blower is coupled to said motor within said dryer housing such that when said motor is rotateably operated, said blower is able to pull ambient air through said intake port and discharge said ambient air through said nozzle;

wherein said steam generator is mounted within said dryer housing;

wherein said heat exchanger is mounted within said dryer housing and is in communication with said power switch such that said ambient air discharged through said nozzle is heated via said heat exchanger;

wherein said top end of said handle is non-removably attached to said dryer housing at about a 90 degree angle to a longitudinal centerline of said dryer housing;

wherein said power switch is mounted within said handle such that said power switch is operable by a user exteriorly of said handle and wherein said power switch is in communication with said at least one rechargeable battery;

wherein said heat disconnect switch is mounted within said handle such that said heat disconnect switch is operable by said user exteriorly of said handle;

wherein said temperature control is mounted within said handle such that said temperature control is adjustable by said user exteriorly of said handle;

wherein said least one rechargeable battery is slideably insertable into said bottom end of said handle such that said rechargeable battery is in communication with said power switch, said steam switch, said temperature control, and said heat disconnect switch; and wherein said cordless electric blow-dryer system is useful for cordless styling of hair of said user and alternately a user-client remotely from a power source.

2. The cordless electric blow-dryer system of claim 1 wherein said steam generator is a sealed tube having a measured volume of H2O interiorly contained.

3. The cordless electric blow-dryer system of claim 1 wherein said temperature control is able to maintain a user preferred internal temperature between 250 degrees Fahrenheit and 500 degrees Fahrenheit.

4. The cordless electric blow-dryer system of claim 1 wherein said heat disconnect switch interrupts an electrically conductive circuit between said rechargeable battery and said heat exchanger to reduce an output air to ambient temperature.

5. The cordless electric blow-dryer system of claim 4 wherein said at least one rechargeable battery comprises a lithium ion iron phosphate battery.

6. The cordless electric blow-dryer system of claim 1 wherein said rechargeable battery is able to power said blow-dryer assembly for at least 1 hour at full power.

7. The cordless electric blow-dryer system of claim 1 wherein said power switch is able to complete an electrically conductive circuit between said at least one rechargeable battery and said steam generator.

8. The cordless electric blow-dryer system of claim 6 wherein said power switch is able to complete an electrically conductive circuit between said at least one rechargeable battery and said motor.

9. The cordless electric blow-dryer system of claim 1 wherein said handle further comprises a grip, said grip substantially covering said handle.

10. The cordless electric blow-dryer system of claim 9 wherein said grip comprises a resiliently deformable material.

11. The cordless electric blow-dryer system of claim 1 wherein said blow-dryer assembly further comprises a battery recharging cradle.

12. The cordless electric blow-dryer system of claim 1 wherein said blow-dryer assembly further comprises a thermal fuse, said thermal fuse preventing an air discharge temperature of said nozzle from exceeding 140 degrees Fahrenheit.

13. The cordless electric blow-dryer system of claim 1 further comprises a circular safety grill concentrically and perpendicularly attached to an end of said nozzle.

14. The cordless electric blow-dryer system of claim 1 wherein said nozzle of said blow-dryer assembly comprises an insulation attached about an inner periphery of said nozzle of said blow-dryer assembly.

15. The cordless electric blow-dryer system of claim 11 wherein said battery recharging cradle comprises 120 volts alternating current input power.

16. The cordless electric blow-dryer system of claim 2 wherein said sealed tube comprises a fill-valve.

17. The cordless electric blow-dryer system of claim 12 wherein said thermal fuse comprises an automatic reset.

18. A cordless electric blow-dryer system comprising:

a blow-dryer assembly having;
a dryer housing having;
at least two housing portions;
at least one air intake port; and
a nozzle;
a motor;
a blower;
a liquid reservoir;
a heat exchanger;
a handle having a bottom end and a top end;
a power switch;
a heat disconnect switch;
a temperature control; and
at least one rechargeable battery;

wherein said at least two housing portions of said dryer housing abut to each other such that said housing portions are able to be removably fastened together to form a hollow containment, said hollow containment having said at least one air intake port and said nozzle formed integrally with said dryer housing;

wherein said nozzle further comprises a circular safety grill concentrically and perpendicularly attached to an end of said nozzle;

wherein said nozzle of said blow-dryer assembly comprises an insulation attached about an inner periphery of said nozzle of said blow-dryer assembly;

wherein said power switch is able to complete an electrically conductive circuit between said at least one rechargeable battery and said steam generator;

wherein said power switch is able to complete an electrically conductive circuit between said at least one rechargeable battery and said motor;

wherein said motor is located within said dryer housing and is in communication with said power switch such that slideably activating said power switch causes said motor to be activated;

wherein said blower is coupled to said motor within said dryer housing such that when said motor is rotateably operated, said blower is able to pull ambient air through said intake port and discharge said ambient air through said nozzle;

wherein said steam generator is a sealed tube having a measured volume of H2O interiorly contained;

wherein said sealed tube comprises a fill-valve;

wherein said heat exchanger is mounted within said dryer housing and is in communication with said power switch such that said ambient air discharged through said nozzle is heated via said heat exchanger;

wherein said top end of said handle is non-removably attached to said dryer housing at about a 90 degree angle to a longitudinal centerline of said dryer housing;

wherein said handle further comprises a grip, said grip substantially covering said handle;

wherein said grip comprises a resiliently deformable material;

wherein said power switch is mounted within said handle such that said power switch is operable by a user exteriorly of said handle and wherein said power switch is in communication with said at least one rechargeable battery;

wherein said heat disconnect switch is mounted within said handle such that said heat disconnect switch is operable by said user exteriorly of said handle;

wherein said heat disconnect switch interrupts an electrically conductive circuit between said rechargeable battery and said heat exchanger to reduce an output air to ambient temperature;

wherein said temperature control is mounted within said handle such that said temperature control is adjustable by said user exteriorly of said handle;

wherein said temperature control is able to maintain a user preferred internal temperature between 250 degrees Fahrenheit and 500 degrees Fahrenheit;

wherein said blow-dryer assembly further comprises a thermal fuse, said thermal fuse preventing an air discharge temperature of said nozzle from exceeding 140 degrees Fahrenheit;

wherein said thermal fuse comprises an automatic reset;

wherein said least one rechargeable battery is slideably insertable into said bottom end of said handle such that said rechargeable battery is in communication with said power switch, said steam switch, said temperature control, and said heat disconnect switch;

wherein said at least one rechargeable battery comprises a lithium ion iron phosphate battery;

wherein said at least one rechargeable battery is able to power said blow-dryer assembly for about 1 hour at full power;

wherein said blow-dryer assembly further comprises a battery recharging cradle;

wherein said battery recharging cradle comprises 120 volts alternating current input power; and wherein said cordless electric blow-dryer system is useful for cordless styling of hair of said user remotely from a power source.

19. The cordless electric blow-dryer system of claim 18 further comprising a kit having:

at least one fully assembled said blow-dryer assembly;

said at least one rechargeable battery;

said at least one battery recharging cradle; and at least one set of user instructions.

* * * * *